United States Patent [19]

Bell

[11] Patent Number: 4,761,627

[45] Date of Patent: Aug. 2, 1988

[54] ELECTROMAGNETIC RELAY INCLUDING A ROTATABLE ARMATURE MOUNT

[75] Inventor: Richard E. Bell, Princeton, Ind.

[73] Assignee: Potter and Brumfield Inc., Princeton, Ind.

[21] Appl. No.: 97,995

[22] Filed: Sep. 17, 1987

[51] Int. Cl.[4] ..... H01H 67/02

[52] U.S. Cl. ..... 335/128; 335/80; 335/83

[58] Field of Search ..... 335/78, 79, 80–84, 335/128, 129–133

[56] References Cited

U.S. PATENT DOCUMENTS

| | | | |
|---|---|---|---|
| 4,302,742 | 11/1981 | Schedele | 335/202 |
| 4,316,164 | 1/1982 | Essler | 335/202 |
| 4,420,733 | 12/1983 | Palandri | 335/202 |
| 4,571,567 | 2/1986 | Nestlen et al. | 335/128 |
| 4,616,201 | 10/1986 | Nagamoto | 335/128 |

FOREIGN PATENT DOCUMENTS 2307283 8/1974 Fed. Rep. of Germany .

*Primary Examiner*—E. A. Goldberg
*Assistant Examiner*—Lincoln Donovan
*Attorney, Agent, or Firm*—John Francis Moran

[57] ABSTRACT

A compact electromagnetic relay of the type having an insulative base (1) adapted to receive an electromagnetic assembly (2, 3, 4) on one side of its partition wall (15) and a contact assembly (6) on the other side includes especially adapted armature (3) and pusher (5). The armature has one leg (32) that is bifurcated to form a slotted opening (324) communicating with a socket (323). The shaft region (55) of the pusher has two cross-sectional dimensions of different size. One dimension d1 allows the slotted opening to freely pass over it while the other dimension d2 prevents the socket from disengaging with the pusher when the armature is rotated to assume its working position.

10 Claims, 2 Drawing Sheets

ELECTROMAGNETIC RELAY INCLUDING A ROTATABLE ARMATURE MOUNT

CROSS-REFERENCE TO A RELATED APPLICATION

The present application is related to U.S. patent application Ser. No. 07/097,996 concurrently filed also on Sept. 17, 1987 which is directed toward a different aspect of the relay configuration wherein both inventions are utilized.

BACKGROUND OF THE INVENTION

1. Field of the Invention

The present invention relates to electromagnetic relays of the type having an electromagnetic coil and an associated core including a yoke (or frame), a contact assembly secured in a base body to which the coil and yoke are attached, and a generally L-shaped armature pivotably mounted on the yoke and disposed for actuating at least one moveable contact element in the contact assembly. This invention relates, more particularly, to the configuration and manner wherein a pusher member engages the armature so as to transfer any movement of the armature to the movable contact element.

2. Description of the Prior Art

Various electromagnetic relays like those described above are known to those skilled in the art and used wherein the movement of the armature is transferred to contact springs through a rod-like pusher member. For example, a relay having such structure is disclosed and illustrated in U.S. Pat. No. 4,420,733. The miniaturized electromagnetic relay illustrated therein includes an exteriorly T-shaped operating member which is shaped in such a way as to be suitable as a driving pusher arm in either a single switching blade and a two switching blade relay embodiment. This operating or driving member rests from one side against an arm of the armature and, from the other side against a moveable contact blade or two contact blades. In this conventional relay, since there is no engagement between the armature and the operating member or pusher, the pusher is guided only by an opening of a partition wall of the insulating base support of a relay. Thus, such an arrangement occasions the development of a significant amount of friction between the pusher and the base structure producing insulating dust due to abrasion. This dust is deleterious since it forms an insulating layer on the contact surfaces thus shortening the operational life on the relay.

SUMMARY OF THE INVENTION

Accordingly, an object of the present invention is to provide a miniaturized electromagnetic relay which is improved with respect to the drive connection between the armature, the pusher and at least one contact spring. More particularly, this invention provides a relay, wherein the armature can be mounted and removed in a relatively simple and convenient manner, but is positively engaged with the pusher so as to be secured against removal once its in working position.

Another object of the invention is to provide improved guidance for the pusher within the relay while reducing friction and abrasive dust thus substantially increasing the reliable working life for the relay.

Still another object is to provide a relay having improved insulation between the armature and the contact elements by means of the particular shape of the pusher.

These and other objects are achieved in accordance with principles of the present invention by providing a relay wherein a first end of the pusher includes an engaging section reduced in diameter and limited between two plate-like beads enlarged in diameter and disspaced from each other in the longitudinal direction of the pusher and wherein the second leg of the armature has a bifurcated end embracing the engaging section of the pusher between these two beads, the bifurcated end of the armature enclosing a recess which is wider than the diameter of the engaging section and narrower than the diameters of either one of the two beads.

In a preferred illustrative embodiment of the invention, the engaging section of the pusher has a generally elliptical cross-section having a longer and a shorter diameter, and the bifurcated end of the second armature leg embraces the engaging section of the pusher in form of a pair of fixed jaw like members defining a slot or opening having a narrowed opening toward the end of the armature leg, the sides of the opening being defined wider than the shorter diameter of the elliptical cross-section of the pusher and narrower than the longer diameter of the elliptical cross-section.

BRIEF DESCRIPTION OF THE DRAWING

Various features of the invention and additional objects thereof will be more readily appreciated and better understood by a reference to the following detailed description which should be considered in conjunction with the drawing.

DESCRIPTION OF THE PREFERRED EMBODIMENT

Figure 1:
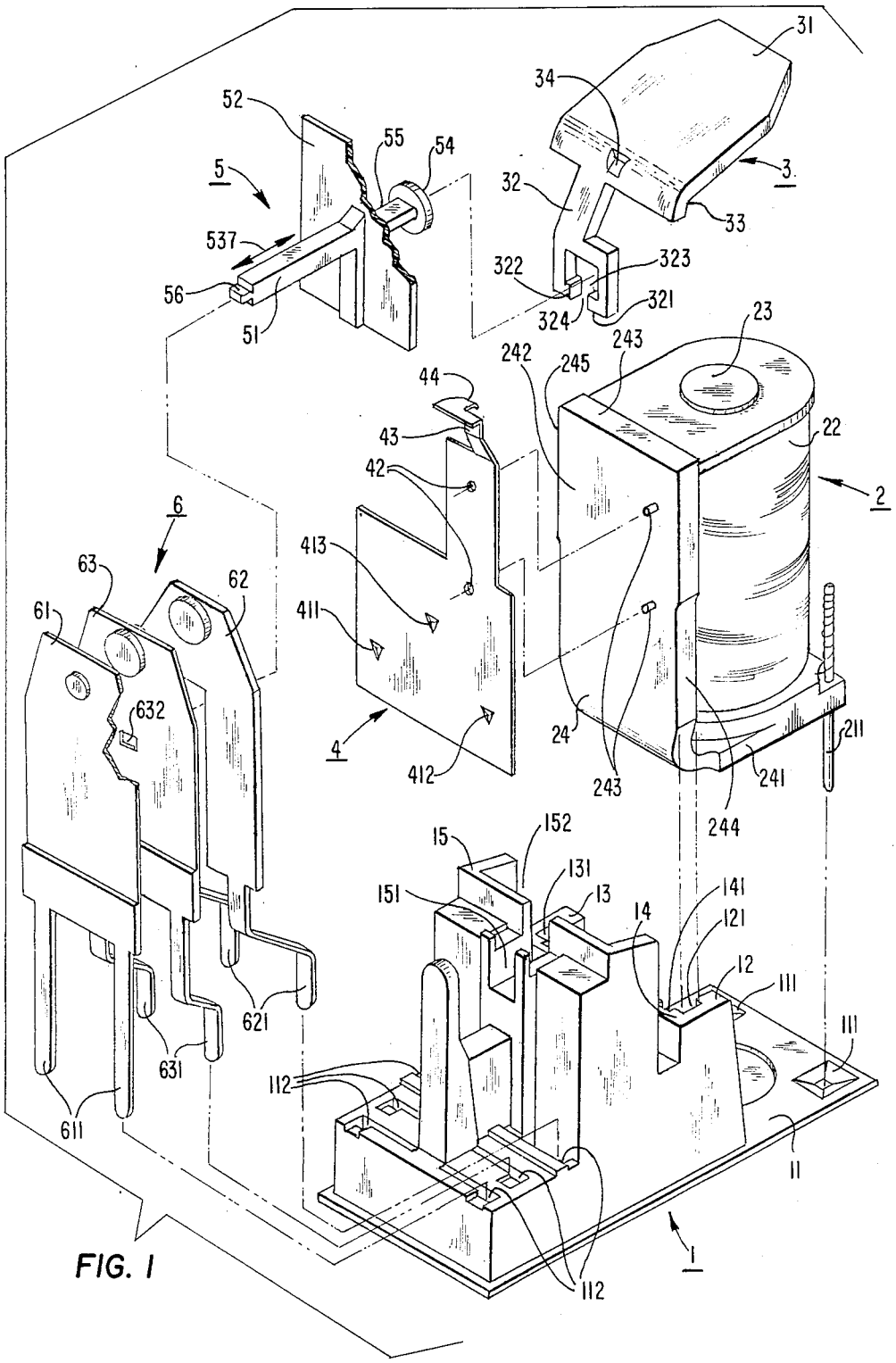
FIG. 1 is an exploded perspective view depicting the various individual component parts of the relay constructed in accordance with the principles of the present invention.

As shown in the drawing Figs., the relay basically comprises a base member generally designated as 1, a coil and yoke assembly 2, an armature 3, a retaining spring 4, a pusher 5 and a contact assembly which is generally labelled as 6.

The support structure 1 may be formed by molding, for instance by injection molding, from plastic material, for example from a polyphenylenesulfide resin, sold under the trademark RYTON. However, any suitable other insulating material may be used which is familar to those skilled in the art. The support structure 1 comprises a generally flat base 11 with through holes 111 for receiving coil terminals 211. From the base 11, two sidewalls or lateral walls 12 and 13 extend perpendicularly and are connected by a partition wall 14 which extends also perpendicularly from the base 11 and divides the space above the base 11 generally into two regions. One of the regions serving to receive and contain the magnetic system or coil and yoke assembly 2, and the other region serving to receive and contain the contact assembly 6.

The contact assembly 6 generally comprises two stationary contact elements 61 and 62 and a flexible contact spring 63 containing a contact which is mechanically actuated by the movement of the armature 3 via the pusher 5 to alternatively contact one or the other of the stationary contact elements 61 and 62. The contact elements 61 through 63 are inserted into slots 112 provided in the base 11 and they are secured therein by applying a suitable resin contained within a reservoir or recess 16 in base 11 (see FIGS. 3 and 5). In the illustrative embodiment, the contact elements 61 to 63 include contact terminals 611 through 631. The terminals 621 and 631 are bent within the base 11 so as to provide increased separation between their connecting terminals over that or the assembled contact spacing. A contact assembly similar to that generally shown at 6 is illustrated and described in greater detail for example in U.S. Pat. No. 4,420,733, however, any other suitable design of contact elements may be readily used.

In accordance with the present illustrative embodiment of the invention, the partition wall 14 only extends about one-half the height of the coil assembly 2 providing clearance for free movement of the lower portion of the armature 3. An additional insulating wall 15 protrudes from the base 11 for guiding the pusher rod 51 which will be described below in greater detail.

The magnet system or coil and yoke assembly 2 comprises a coil body 21 carrying a winding 22, a magnetic 23 inserted in the coil body and an angled yoke 24 which has a first leg 241 extending perpendicular to the core and connected to the core 23. The angled yoke 24 has a second yoke leg 242 extending parallel to the core. At the free end of the core leg 242, edge 243 serves as a fulcrum 243 for receiving an interior bearing surface 33, or the interior portion of its angular vertex, of the angled armature 3.

This armature 3 includes two basic portions. The angle formed between the two basic portions is greater than a right angle. The first portion is a first armature leg 31 which completes the magnetic circuit of the armature 3 while providing a working air gap with the core 23. The second portion is a second armature leg 32 extending in a generally parallel direction to yoke leg 242 and also engages the pusher 5 for actuation by transferring the motion of closing the air gap into moving the center contact 63 from one stationary contact to the other stationary contact.

The retaining spring 4 is generally made from a leaf spring material such as copper alloy, but may be made of any other suitably resilient metal. A first flat or planar portion 41 of the retainer spring extends parallel to yoke leg 242 and is secured against the yoke leg. A pair of holes 42 are provided in the first portion 41 to mate with a corresponding pair of stand-offs 243 protruding from the yoke leg 242. A retaining arm 43 extends upward from the first portion 41 of the retaining spring 4 and terminates with an inwardly split extending along the direction of the length of arm 43 to provide an outwardly projecting bent tip end 44. Bent tip 44 provides spring pressure at an indentation 34 of the armature 3. The retaining arm 43 extends from the first portion 41 offset to one side in order to allow unobstructed crossing with the asymmetrically shaped second armature leg 32. This offset enables the first portion 41 to be attached to the yoke leg 242 underneath the armature leg 32 while the retaining arm 43 provides downward pressure on the armature 3 via bent tip 44 from above.

Figure 3:
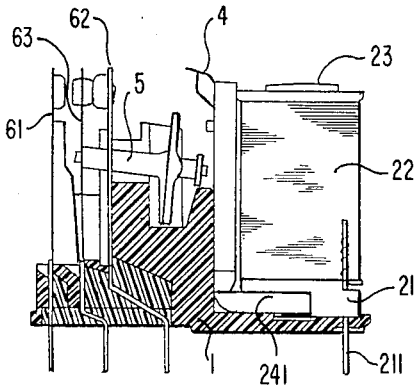
FIG. 3 is a side view of a partly assembled electromagnetic relay, without the armature and with the base portion illustrated in cross-sectional form.

As illustrated in FIGS. 1 and 3, the pusher 5 includes a pusher rod or bar 51 having a rectangular or square cross-section which fits in a guiding channel 151 of the insulating wall 15 to allow movement of the pusher rod 51 along its longitudinal axis 53. Obviously, the pusher rod 51 may also have any other suitable cross-secton. At its first end which consistently appears as the right hand end throughout the Figs., the pusher 5 provides a plate-like end flange or bead 54 and, apart from the end an intermediate flange 52, both of which are enlarged in diameter with respect to the pusher rod 51. The flanges 52 and 54 enclose or limit an engaging section 55 which is approximately elliptical or rectangular in cross-section. Specifically, the cross-section of section 55 has shorter vertical dimension d1 than is (longer) horizontal dimension d2. The large intermediate flange 52 of the pusher is received in a recess 152 of the insulating wall 15 to provide a labyrinth insulative configuration together with the wall 15. The other or second end of the pusher 5 has a end tip portion 56 to provide proper engagement with the contact spring 63. As depicted in the illustrative embodiment, the end portion 56 has a rectangular cross-sectional which fits in a corresponding rectangular hole 632 of the contact spring 63. Due to this rectangular cross-section, the pusher is prevented from twisting about its longitudinal axis, however, this affect could also be achieved by other keying means. On the side facing the engaging portion 55, the flange 52 has a raised surface position forming a transverse rib 57 to allow relatively free rolling movement between the second armature leg 32 and the pusher 5 while the angle between the armature and the pusher changes during switching movement.

Figure 2:
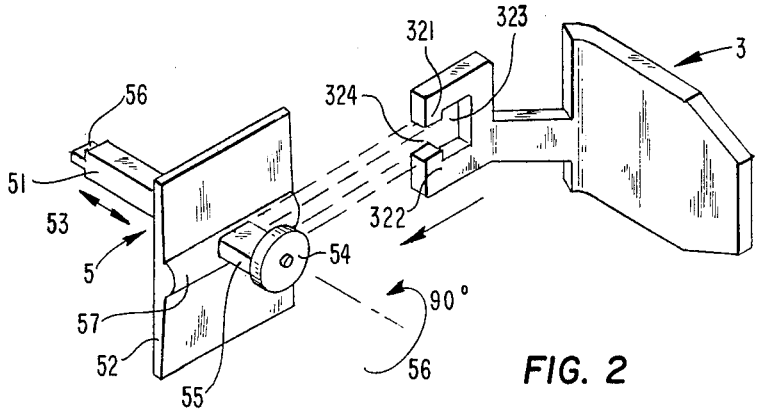
FIG. 2 is a perspective view of the pusher and the armature illustrating the assembling procedure for these two parts.

The second armature leg or arm 32 has a bifurcated end portion formed to include a pair of clamping members 321 and 322 provided for embracing the engaging section 55 of the pusher 5. The members 321 and 322 form a socket 323 having a narrowed opening 324. The opening 324 has a width which is wider than the shorter diameter d1 of the pusher but narrower than the longer diameter d2 of that pusher. Thus, the open socket 323 of armature leg 32 is adapted to freely fit around the engaging portion 55 of the pusher 5 from the side as shown in FIG. 2. When the armature 3 is maintained in this position with the socket 323 around the engaging section 55 and turned or twisted in the direction of the arrow 56 through an angle of 90 degrees about the longitudinal axis 53 or the pusher 5, the armature leg 32 and the engaging section 55 will be locked with each other in any direction. Another descriptive term for partially closed socket 323 is the term of T-slot.

Now, the assembling action of the relay will be described in greater detail. First, the contact elements 61 through 63 are inserted into their respective holes 112 of the base 1 and fixed in a suitable manner, for example, by potting. Then, the pusher 5 is inserted into the guiding channel 151 of the insulating wall 15 and engaged at its tip end 56 with the hole 632 of the contact spring 63. Thereafter, the coil and yoke assembly is added and inserted into the base 1 together with the retainer spring 4. For this purpose, the retainer spring 4 is placed with its first part 41 against the outer surface of the yoke leg 242, the stand-off 243 engaging the holes 42. Then these parts preassembled in this way are pushed downward into the base structure 1 by inserting the side edges 244 and 245 into the corresponding grooves 121 and 131, respectively. While these parts are pushed downward, the tabs 411, 412 and 413 bite into the material of the partition wall 14, thus preventing the removal of the yoke leg 242 and the retainer spring in the reverse direction. Now, the relay is in the mounting stage illustrated in FIG. 3.

Figure 4:
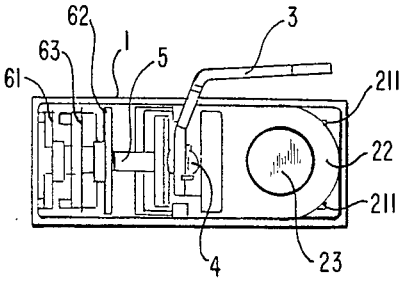
FIG. 4 is a top view demonstrating the first stage of armature mounting.

As may be seen from FIG. 3, the pusher 5 is only held by its second end and its tip 56 at the contact spring 63, but hangs downward with its first end within the recess 152 of the insulating wall 15. Now, the armature is mounted from laterally from the side so that the socket 323 freely accepts the engaging portion 55 of the pusher 5 via the opening 324, as demonstrated in FIG. 2 by arrow 58. After inserting the armature in the direction of the arrow 58 of FIG. 2, the final mounting stage of FIG. 4 is still not obtained since the first armature leg 31 is not yet in its working position. Thus, the armature 3 is twisted or turned in the direction of the circle arrow 59 (illustrated in FIG. 2) by 90 degrees about the axis 53 of the pusher 5. Due to this action and the relative geometries of the socket 323 and section 55, the engaging section 55 of the pusher 5 becomes trapped or enclosed within the socket 323 of the armature leg 32 and the pusher assumes a position wherein its longitudinal axis 53 is approximately horizontal. Thus, rubbing surfaces are avoided so that essentially no friction exists between the pusher 5 and any other plastic material of the separate structure 1 while the pusher 5 is only held at its ends between the armature leg 32 and the contact spring 63, respectively. Because the bearing surfaces between a plastic part and a metallic part produces less friction than between two plastic parts, actuation of the pusher 5 in accordance with the inventive principles consumes less energy and produces less abrasive dust, compared to prior art relays.

Figure 5:
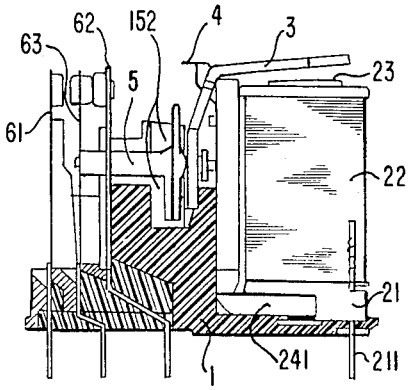
FIG. 5 is a side view of a fully assembled relay wherein the working position of the armature is illustrated.

By the turning action of the armature as described in the foregoing, the armature assumes its working position, wherein, the bearing surface 33 now rests on the fulcrum edge 243 and underneath the tip end 44 of the retaining spring 4. The relay thus completed is illustrated in FIG. 5. After that, a cap or cover which is not shown can be snapped onto the separate structure to form a housing for the relay in a conventional manner. If necessary, the housing may be sealed in a conventional manner.

There has thus been shown and described a novel relay configuration which fulfils all the objects and advantages sought therefor. Many changes, modifications, variations and other uses and applications of the subject invention will, however, become apparent to those skilled in the art after considering this specification and the accompanying drawing which disclose the preferred embodiments thereof. All such changes, modifications, variations and other uses and applications which do not depart from the spirit and scope of the invention are deemed to be covered by the invention which is limited only by the claims which follow.

I claim:

1. An electromagnetic relay comprising:

(a) an electromagnetic coil having an axis and a core coextensive with said axis;

(b) an angled yoke having a first yoke leg perpendicular to said axis and adapted to receive said core and a second yoke leg parallel to the axis, said second leg having a free end serving as a fulcrum;

(c) a plurality of contact elements comprising at least one stationary contact element and at least one moveable contact element secured in a base body, said yoke including said coil mounted on said base body;

(d) a generally L-shaped armature pivotally mounted on said fulcrum and having a first leg forming a working air gap with said core and a second leg extending generally parallel to said axis, the first leg of the armature being actuated by said armature responsive to the electromagnetic coil by moving to reduce the working air gap when the coil is energized;

(e) a pusher member for transferring movement of the armature to the at least one moveable contact, the pusher member having a longitudinal axis and having a first end portion engaged with said second armature leg and a second end portion engaged with said at least one moveable contact element, said first end of the pusher member including an elongated section extending between two retaining means displaced laterally and extending circumferentially from said elongated section, for defining its length; and (f) said second armature leg having a bifurcated end adapted to slide over and embrace said elongated section of the pusher member between said two retaining means, the bifurcated end of the armature having an opening and a socket, the opening adapted to freely slide around one dimension of the elongated section while the socket is longitudinally restricted between said two retaining means and the other dimension of the elongated section being larger than the one dimension.

2. An electromagnetic relay comprising:

(a) an electromagnetic coil having an axis and a core coextensive with said axis;

(b) an angled yoke having a first yoke leg perpendicular to said axis and adapted to receive said core and a second yoke leg parallel to the axis, said second leg having a free end serving as a fulcrum;

(c) a plurality of contact elements comprising at least one stationary contact element and at least one moveable contact element secured in a base body, said yoke including said coil mounted on said base body;

(d) a geneally L-shaped armature pivotally mounted on said fulcrum and having a first leg forming a working air gap with said core and a second leg extending generally parallel to said axis, the first leg of the armature being actuated by said armature responsive to the electromagnetic coil by moving to reduce the working air gap when the coil is energized;

(e) a pusher member for transferring movement of the armature to the at least one moveable contact, the pusher member having a longitudinal axis and having a first end portion engaged with said second armature leg and a second end portion engaged with said at least one moveable contact element, said first end of the pusher member including an elongated section extending between two retaining means displaced laterally and extending circumferentially from said elongated section, for defining its length;

(f) said second armature leg having a bifurcated end adapted to slide over and embrace said elongated section of the pusher member between said two retaining means, the bifurcated end of the armature having an opening and a socket, the opening adapted to freely slide around one dimension of the elongated section while the socket is longitudinally restricted between said two retaining means;

(g) the elongated section of the pusher having a generally elliptical cross-section having a first diameter and a second diameter wherein the first diameter exceeds the second diameter; and (h) the bifurcated end of the second armature leg, embracing the elongated section of the pusher in form of a pair of claws defining said socket having an opening of the end of the armature leg, the width of the opening being wider than the second diameter of said elliptical cross-section of the pusher and narrower than the first diameter of said elliptical cross-section.

3. A relay according to claim 2, wherein said second end of the pusher includes keying means, engaged with the at least one moveable contact element, for preventing the pusher from turning about its longitudinal axis.

4. A relay in accordance with claim 3, wherein the keying means on said pusher keeps the second axis of said elongated section in a direction oriented subtantially parallel to the longitudinal extension of said second armature leg while occupying its working position, whereby mounting the armature is accomplished by sliding the opening of the bifurcated end over the elongated section of the pusher from a side perpendicular to its working position and bringing it into its working position by turning it by an angle of 90° about the longitudinal axis of the pusher.

5. A relay according to claim 3, wherein a channel formed in the base body receives the pusher while allowing movement in its longitudinal direction.

6. A relay according to claim 1, wherein said two retaining means formed on the pusher comprise an end bead and an intermediate bead, said intermediate bead being larger in diameter and providing a labyrinth of insulation together with an intermediate wall of the base body.

7. An electromagnetic relay having a base including a flat portion and supporting an electromagnetic assembly, the electromagnetic assembly including a coil containing a core mounted on a yoke which circumferentially extends around the coil, a contact assembly including at least one stationary contact and at least one moveable contact, a pivotable armature having a first portion extending between the yoke and the core having a normal position defining an air gap between it and the core, the relay comprising: a second portion of the pivotable armature having a bifurcated end region forming a slotted opening communicating with a socket, a pushing member disposed between the second portion of the armature and the moveable contact for operating the relay, the pusher member having a shaft portion of two different cross-sectional dimensions extending between two retainers, the shaft region having only one cross-sectional dimension less than the slotted opening enabling the bifurcated end of the armature to be mounted thereon while being longitudinally secured between the two retainers, and the bifurcated end restricting movement of the pushing member in a direction perpendicular to the flat portion of the base while holding the pushing member in its operating position.

8. An electromagnetic relay in accordance with claim 7, wherein the one cross-sectional dimension is oriented perpendicular to the flat portion of the base so that the armature is placed on the shaft region while its second portion is oriented laterally to the at least one cross-section dimension.

9. An electromagnetic relay in accordance with claim 8, wherein the other cross-sectional dimension is oriented perpendicular to the at least one cross-sectional and is the larger of the two cross-sectional dimensions so that when the armature assumes its working position by being rotated about a quarter of a turn from its mounting orientation its slotted opening is oriented the same as the other cross-sectional dimension and retains the pushing member in an operating position.

10. A relay in accordance with claim 9, wherein a retaining spring holds the armature in its normal working position, the retaining spring having a bifurcated end adapted to receive the armature laterally while being rotated from its mounting position to its working position.

* * * * *